United States Patent [19]

Benning

[11] 4,353,528

[45] Oct. 12, 1982

[54] RESTRAINING DEVICE

[75] Inventor: Vernon A. Benning, Maidenhead, England

[73] Assignee: M.L. Aviation Company Limited, Berkshire, England

[21] Appl. No.: 158,396

[22] Filed: Jun. 11, 1980

[30] Foreign Application Priority Data

Jun. 22, 1979 [GB] United Kingdom ..... 7921830

[51] Int. Cl.[3] ..... B66D 1/08

[52] U.S. Cl. ..... 254/360; 24/134 N; 188/65.1; 188/75; 188/79.5 GT; 244/110 H; 254/391

[58] Field of Search ..... 254/391, 360, 384, 251-260; 242/107.2, 156, 149, 99, 55; 188/64, 65.1-65.5, 79.5 GT, 75, 76, 188; 244/110 R, 110 A, 110 C, 110 H; 24/134 N, 132 R, 134 R, 252 R, 253

[56] References Cited

U.S. PATENT DOCUMENTS

| | | | |
|---|---|---|---|
| 604,557 | 5/1898 | Baum | 188/188 |
| 1,231,014 | 6/1917 | Goodwill | 24/134 R |
| 1,360,458 | 11/1920 | Skogman | 24/134 R |
| 1,466,007 | 8/1923 | Walton | 24/134 R |
| 1,809,068 | 6/1931 | Roth | 24/134 R X |
| 3,143,192 | 8/1964 | Buchanan | 188/65.1 |
| 3,146,754 | 9/1964 | Ohnsman | 24/134 R X |
| 3,292,742 | 12/1966 | Thomas | 188/75 |
| 3,301,532 | 1/1967 | Lock et al | 254/360 X |
| 3,589,651 | 6/1971 | Niemkiewicz | 242/149 X |
| 3,737,123 | 6/1973 | Carnevale | 188/65.1 X |
| 3,911,535 | 10/1975 | Mauron | 242/107.2 X |
| 4,106,753 | 8/1978 | Cavalieri et al. | 188/65.1 X |

*Primary Examiner*—John M. Jillions

*Attorney, Agent, or Firm*—Larson and Taylor

[57] ABSTRACT

A restraining device for controlling the movement of a loaded strop 3 comprises a power-driven reel for the strop and an associated pair of toggle-controlled clamping jaws 14, 15 pivoted at 16 and 17 respectively. The jaws are cross-connected by a link 18 and are loaded into the operative position to grip the strop 3 by a spring 25. The controlling toggle comprises links 28 and 30 pivoted together at 31, the link 28 being pivoted to the jaw 15 at 29 and the link 30 being pivoted to a fixed point 32. The link 30 carries a pivoted hand-lever 35 for releasing the toggle and formed with a hook portion 42 which engages with a corresponding hook portion 44 on the link 28 to lock the toggle in the released position to free the strop. The lever 35 can be released either manually or automatically by the piston 37 of a pneumatic cylinder 38. When the lever is released, the toggle moves to the braced position where it assists the action of the spring 25 in holding the jaws together to grip the strop.

8 Claims, 3 Drawing Figures

Fig. 3.
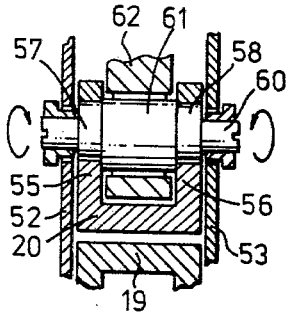
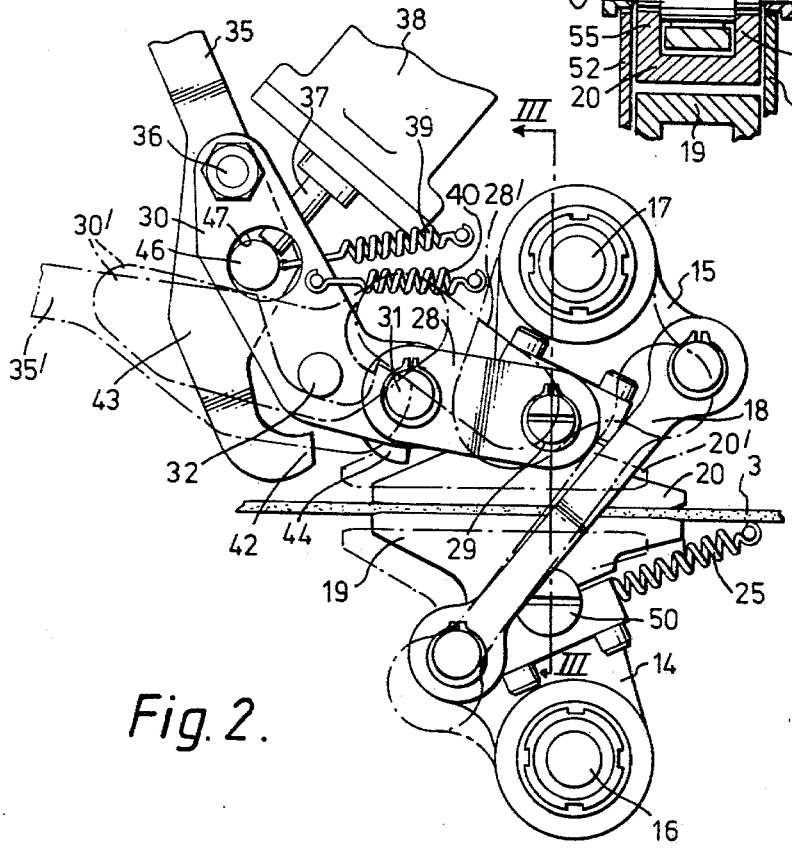
Fig. 2.

RESTRAINING DEVICE

This invention relates generally to restraining systems for holding an aircraft or other equipment in position on steep, slippery or moving surfaces such as the deck of a ship at sea by means of a number of strops attached to the equipment and each held at the opposite end by means of a restraining device secured to the surface in question. It is with the individual restraining devices that the invention is primarily concerned and which are intended to perform basically the same function as the device described in our British Pat. No.: 1,448,870. There is thus the general requirement that each restraining device should be capable of holding the associated strop against the effect of any forces likely to be experienced in practice, so as to hold the aircraft or other equipment firmly in position, but that it should be capable of releasing the strop when required so as to allow movement of the aircraft or other equipment and then of arresting the movement of the strop as soon as the required position of the equipment has been reached.

According to the present invention, a restraining device for this purpose comprises a power-driven reel for the strop and guide rollers defining a path for the strop which includes a pair of toggle-controlled clamping jaws which are spring loaded into the operative position and are capable of being released either manually or under remote control. Preferably the reel is driven by a compressed air motor which can turn the reel to take up the slack in the strop, but is not damaged by being stalled for long periods or by being counter-rotated against the direction of drive when the strop is unreeled and the tension applied to it exerts a greater torque on the reel than that of the motor.

Generally speaking, each aircraft or other piece of equipment will be controlled by four or six strops, in a suitably balanced arrangement, each controlled at the opposite end by a respective restraining device. While the aircraft is being moved into its required position, the individual strops may be paid out from their reels or the slack may be taken up by the drive from the compressed air motor, but when the final required position is reached or if, at any stage in the movement, it is necessary to check that movement, any one or more of the strops can be clamped in position almost instantaneously by the operation of the clamping jaws of the respective restraining device or devices. If remote control is used, a single operator can control all of the restraining devices, for example by means of a control switch as described in our co-pending U.S. application Ser. No. 131,196, filed Mar. 17, 1980, now abandoned.

The clamping jaws are each preferably pivoted and have a cross-connecting link so that they pivot together in opposite directions. As a consequence, tension in a strop, when clamped, tends to turn the jaws about their respective pivots and, at the same time, to bring them slightly closer together so as to increase the clamping action, thus having a self-servo action. It is important that the jaws should not clamp the strop more tightly than is necessary to resist the maximum tension likely to be encountered since otherwise the strop itself will be damaged. To ensure that the distance between the jaws when in their closest position should bear the correct relationship to the thickness of the strop, for the purpose just mentioned, each jaw preferably includes a separate jaw piece which is adjustable in relation to the pivoted member as a whole by means of an eccentric connection which allows a particularly accurate adjustment to be achieved.

As mentioned originally, the jaws are operated under toggle control, the closest together position of the jaws corresponding to the braced or dead-centre position of the toggle. The jaws are biased towards this position by the spring loading and the release action is thus required to move the toggle away from its braced position against the effect of the spring loading. For this purpose, one of the toggle links preferably carries a pivoted manual control lever which is operative to move the toggle as a whole away from the braced position and is capable of being locked in this position so as to hold the jaws apart against the action of the spring loading. If, with the jaws held apart in this way, it is necessary to clamp the strop at short notice, the manual control lever can be moved to its inoperative position either by direct manual action or under remote control.

An example of restraining device operating in this manner will now be described with reference to the accompanying drawings, in which:

FIG. 2 is a view of pivoted clamping jaws forming part of the device shown in FIG. 1; and FIG. 3 is a sectional view taken on the line III—III in FIG. 2 and illustrating the adjustment of a jaw piece.

Figure 1:
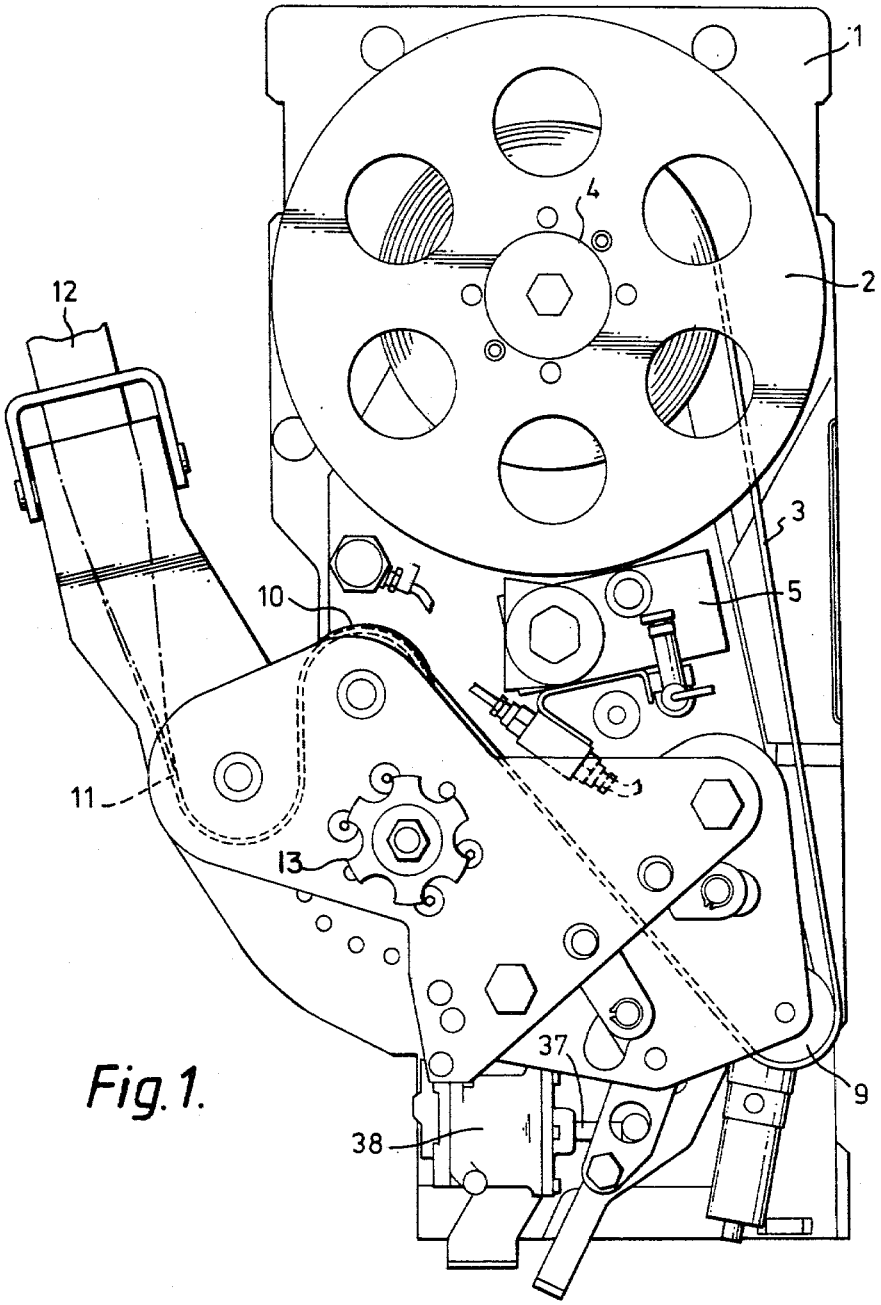
FIG. 1 is a view of the device as a whole.

Turning first to FIG. 1, the device comprises a mounting plate 1 carrying a reel 2 for a strop 3, the end of which is secured to a hub portion 4 of the reel 2. The reel 2 is driven through reduction gearing (not shown) by a compressed air motor 5 which can be counter-rotated when the strop is being paid out and which can safely remain for long periods in a stalled condition when the strop 3 is clamped.

The strop 3 passes tangentially from the reel 2 and then follows a path defined by guide pulleys 9, 10 and 11, leaving the device as shown at 12. Between the pulleys 9 and 10 the strop 3 passes between a pair of jaws 14 and 15 seen in FIGS. 2 and 3. The jaws are pivoted at 16 and 17 respectively and are cross-connected by a pivoted connecting link 18. Each pivoted jaw includes an independently adjustable engagement portion or jaw piece 19, 20 respectively which exerts a gripping action on the strop 3.

The mounting plate 1 of the device is secured to the deck of a ship or other surface by way of an anchorage point which is bolted to the surface and includes facilities for connection to compressed air and electrical supplies. The connection is made by way of a spring-loaded hook fixing which is not illustrated in the drawing, but is similar to that shown in British Pat. No.: 1,448,870, referred to above. The hook is engaged with the anchorage point and its threaded shank is engaged by a star wheel seen at 13 in FIG. 1 which can be tightened by key or by hand. When attached, the hook is held within a steel boss which enables the restraining device as a whole to be located in the correct angular position, a circular plate on the underside of the plate 1 being orientated to fix the position of the plate 1 in relation to the anchorage plate.

The control of the strop 3 is primarily exercised by the clamping jaws 14 and 15 which will now be described in more detail with reference to FIGS. 2 and 3.

The jaws are spring loaded by a tension spring 25 connected to the pivoted jaw 14 so as to turn it in a clockwise direction, the jaw 15 being loaded in an anti-clockwise direction as a result of the connecting link 18. This brings the jaw pieces 19 and 20 together to grip the strop 3 and tension of the strop to the right as seen in FIG. 2 tends to turn the two jaws further in the same direction as biased by the spring 25, thus producing the self-servo action referred to previously.

Control of the jaws 14 and 15 is exerted by a toggle linkage comprising a straight link 28 pivoted to the jaw 15 at 29 and to a second, cranked link 30 at 31. The link 30 is pivoted at a fixed pivot point 32, the extension of this link to the left hand side of this pivot being for control purposes so as to release the jaws 14 and 15 from the effect of the spring loading. In the position illustrated in full lines in FIG. 2, the toggle constituted by the links 28 and 30 is in the braced position, that is to say with the pivot points 29, 31 and 32 substantially in a straight line. In this position, the toggle provides a thrust which augments the effect of the spring loading.

In order to release the jaws 14 and 15 to allow the strop 3 to be paid out quite freely, the jaw 15 is turned in a clockwise direction under the control of the toggle as a result of anti-clockwise turning movement of the link 30 to the position shown in dotted lines as 30′, the link 28 turning in a clock-wise direction to the position shown as 28′. This moves the pivot point 31 upwardly and hence withdraws the pivot 29 slightly to the left, thus turning the jaw 15 in a clockwise direction and the jaw 14 in an anti-clockwise direction. Turning of the link 30 in an anti-clockwise direction for this purpose can be produced either by means of a manual control lever 35 pivoted to the link 30 at 36 or by the piston 37 of a pneumatic cylinder 38.

If the manual control lever 35 is moved to the left as shown in FIG. 2, to a position shown in dotted lines as 35′, in opposition to the tension of a spring 39, so as to turn in an anti-clockwise direction about its pivot 36, it turns the link 30 in an anti-clockwise direction against the effect of a loading spring 40 and at the same time a hook portion 42 on the end of a downward extension 43 of the lever 35 engages and locks with a corresponding hook portion 44 on the link 28. This position is illustrated in dotted lines in FIG. 2, the locking of the hook portions 42 and 44 holding the link 30 in its rotated position against the tension of the spring 40. In this position, the pivot 31 has been raised to an appreciable extent above the line joining the pivots 29 and 32, thus turning the jaw 15 in a clockwise direction and the jaw 14 in an anti-clockwise direction to separate the two jaw pieces 19 and 20 and thus to free the strop 3. With the toggle locked in the position of FIG. 2 by inter-engagement of the hook portions 42 and 44, the strop 3 can be reeled or unreeled quite freely so as to permit manoeuvring of the attached aircraft or other equipment.

If, however, it is required to clamp the strop 3 at short notice, this can be carried out either manually or automatically. Manual operation merely requires the lever 35 to be returned to the full line position of FIG. 2, so as to disengage the hook portions 42 and 44 and to allow the toggle to return to the braced position under the control of the tension spring 40. A similar result is achieved automatically by operation of the pneumatic cylinder 38 to cause its piston 37 to engage a pin 46 extending from the surface of the extension 43 of the lever 35 through a circular opening 47 in the link 30. Engagement with the pin 46 thus turns the lever 35 in a clockwise direction about its pivot 36, thereby freeing the hook members 42 and 44 and allowing the toggle to return to the braced position of FIG. 2 under the control of the spring 40.

It will be seen that the pin 46 has a limited range of movement within the circular opening 47 in the link 30, thus providing a degree of lost motion between the lever 35 and the link 30. The first effect of applying pneumatic pressure to the cylinder 38 is to disengage the hook portions 42 and 44 and thus allow the upper portion of the link 30 to move to the right as seen in FIG. 2, under control of the spring 40. If continued pneumatic pressure is applied to the cylinder 38 the pin 46 is firstly moved until it engages the edge of the opening 47. Thereafter, the movement of the piston 37 is transmitted to the link 30, thus turning it in an anti-clockwise direction against the action of the spring 40 and separating the jaw pieces 19 and 20 in the manner previously described in connection with the operation of the lever 35.

In other words, the pneumatic cylinder 38 has a dual function. As a result of a steady applied pressure, it can function to separate the jaws 19 and 20 and thus to release the strop 3 and hold the jaws in this position for as long as required. Alternatively, if the jaws are held in the separated position as a result of operation of the lever 35, so that the hook members 42 and 44 are engaged, a brief pulse of pressure to the cylinder 38 unlocks the hook members 42 and 44 and allows the jaws to return to the clamping position under the control of the loading spring 25.

The jaw pieces 19 and 20 are adjustably secured to the respective jaws 14 and 15 by means of respective adjustable connections, that for the jaw 14 being shown as 50 in FIG. 2, but being hidden by the pivot 29 and its associated parts in respect of the jaw 15. The purpose of this adjustment is to ensure that in the braced position of the toggle, i.e. in which the pivots 29, 31 and 32 are in a straight line as illustrated in FIG. 2, the pressure exerted by the jaw pieces 19 and 20, which is a maximum at this point, is not sufficiently great to damage the strop 3. In other words, the jaw pieces 19 and 20 are adjustable towards and away from one another so as to secure optimum operation.

FIG. 3 shows details in cross section of the connection for jaw 15 the corresponding connection for the jaw 14 being similar. This view shows that the jaws generate between spaced side plates 52 and 53 and that the associated jaw pieces 19 and 20 are of similar hollow construction and are adjustable between the spaced side plates. Thus each jaw piece comprises spaced portions 55 and 56 formed with circular openings engaged by respective eccentrics 57 and 58 on a spindle 60 which spans the side plates 52 and 53. The spindle 60 is mounted to turn in a central reinforcing member 62. The centre line of the two eccentrics 57 and 58 lies below that of the spindle 60 which is provided at each end with a screwdriver slot 68 for adjustment purposes. It will therefore be seen that a small turning movement of the spindle 60 results in associated precise adjustment of the respective jaw piece 19, 20 towards or away from the co-operating jaw piece.

In this way an accurate clamping action on the strop 3 is ensured which can, as a result of adjustment, be given its maximum safe value without damaging the strop. By means of the arrangements already described, the strop 3 can be freed, being reeled in by operation of the compressed air motor 5 or paid out as a result of applied tension which counter-rotates the motor 5. At any required instant, however, the clamping jaws can be brought into operation to clamp the strop 3 and prevent any further movement and when the final position of the aircraft or other equipment has been reached, the equipment can be completely de-energised, leaving the loading spring 25 to maintain a continuous clamping action on the strop 3.

The pivot 29 between the jaw 15 and the link 28 is shown as constituted by a pin projecting from the jaw 15 and engaging a slot in the link 28. This slot may be slightly elongated in the direction of the length of the link 28 (not visible in the drawing) to provide an extension of motion in the toggle locking action which under normal circumstances of "no hazard," i.e. no heavy strop loading, is not taken up. Under these conditions, the clamping jaws will not move from their initial clamping position. No extreme force is required for the toggle unlocking action.

In a hazard condition, however, when the strop is subjected to heavy loading, the slot permits further motion of the jaws which results from the servo action of the toggle clamping mechanism to increase the clamping load. Thus under these circumstances, when the hazard condition has passed, the toggle retains its capability of full action to pull against any external load applied to the strop, without increasing the force required for the unlocking action.

I claim:

1. A restraining device for controlling the movement of a loaded strop, said device comprising a reel means for said strop, power means for turning said reel means, and means defining a path for said strop from said reel, said path including a pair of clamping jaws for gripping said strop, spring means loading said jaws into an operative position to grip said strop, interconnecting means for interconnecting said jaws for movement together towards and away from each other, and a toggle means for producing relative movement of the jaws to clamp and release the strop, the toggle means comprising first and second toggle links pivoted together at a first pivot connection, the first link having a second pivot connection operatively engaged with one of the clamping jaws, and the second toggle link having a third pivot connection, the two toggle links being arranged with the three said pivot connections aligned to assist the spring means to clamp the jaws, and said toggle links being movable to move the first pivot connection out of line with the second and third pivot connections to release the jaws.

2. A restraining device according to claim 1 in which said power means for turning said reel comprises a compressed air motor.

3. A restraining device according to claim 1 and further including pivot means mounting said jaws for pivoting movement about respective pivot axes, said interconnecting means causing said jaws to turn together about their said pivot axes in opposite directions, whereby said jaws turn together in opposite directions in such a way that tension in a strop, when clamped, tends to turn said jaws about said pivot axes to bring said jaws closer together so as to increase the clamping action.

4. A restraining device according to claim 3 in which each jaw includes a separate engagement portion which engages the strop and an eccentric connection means between each said jaw and its said engagement portion to adjust the position of said engagement portion in relation to its respective jaw.

5. A restraining device according to claim 3 in which said toggle means define a braced position in the jaw clamped condition, a manual control lever, said third pivot connection pivoting said control lever to said second link, said control lever being operative to move said toggle means away from said braced position to a released position and locking means for locking said control lever to hold said toggle means in said released position and thereby hold said jaws apart.

6. A restraining device according to claim 5 and also including a pneumatic cylinder for releasing said locking means for said control lever and a lost motion connection between said control lever and said first link, whereby when said control lever has been moved from its locked position further movement serves to separate said jaws.

7. A restraining device according to claim 1 said second pivotal connection comprising a pin turning in an opening having a dimension which is greater than the diameter of said pin.

8. A restraining device for controlling the movement of a loaded strop, said device comprising a reel for said strop, power means for turning said reel, guide rollers defining a path for said strop from said reel, said path including a pair of clamping jaws for gripping said strop, spring means loading said jaws into an operative position to grip said strop, toggle means for producing relative movement of said jaws and release means for said toggle means, each jaw including a separate engagement portion which engages the strop and an eccentric connection means between each said jaw and its respective engagement portion to adjust the position of said engagement portion in relation to its respective jaw.

* * * * *